US006102257A

United States Patent [19]

Goyet

[11] Patent Number: 6,102,257

[45] Date of Patent: Aug. 15, 2000

[54] CLOSURE CAPSULE, IN PARTICULAR FOR A RECEPTACLE THAT IS TO CONTAIN A COSMETIC

[75] Inventor: Daniel Goyet, Saint Witz, France

[73] Assignee: L'Oreal, Paris, France

[21] Appl. No.: 09/132,703

[22] Filed: Aug. 12, 1998

[30] Foreign Application Priority Data

Aug. 21, 1997 [FR] France ..... 97 10553

[51] Int. Cl.[7] ..... B65D 5/72

[52] U.S. Cl. ..... 222/498; 222/517; 222/556

[58] Field of Search ..... 222/556, 517, 222/498; 215/235; 220/831, 832, 837, 838, 839, 847

[56] References Cited

U.S. PATENT DOCUMENTS

| | | | |
|---|---|---|---|
| 4,625,898 | 12/1986 | Hazard | 222/235 X |
| 4,969,574 | 11/1990 | Shastal | 222/235 X |
| 5,038,957 | 8/1991 | Gross . | |
| 5,271,536 | 12/1993 | Wilson | 222/498 |
| 5,735,418 | 4/1998 | Erb et al. | 222/235 X |

FOREIGN PATENT DOCUMENTS

| | | |
|---|---|---|
| 30 18 908 A1 | 11/1980 | Germany . |
| 91 12 615 | 3/1993 | Germany . |
| 296 04 896 U1 | 7/1996 | Germany . |
| WO 93/15963 | 8/1993 | WIPO . |

*Primary Examiner*—Kevin Shaver
*Assistant Examiner*—Thach Bui
*Attorney, Agent, or Firm*—Oliff & Berridge, PLC

[57] ABSTRACT

The invention relates to a closure capsule for a receptacle, the capsule being of the type comprising a body for fixing on the receptacle and provided with a dispenser orifice, and a cover suitable for pivoting between a closed position in which it covers said orifice to close it, and a fully-open position in which it uncovers said orifice to enable the substance contained in the receptacle to be dispensed. The cover is connected via a film hinge to a link member secured to the body of the capsule. The capsule body has a portion in relief, and the cover is shaped to go past said portion in relief by elastic deformation prior to reaching its fully-open position.

10 Claims, 4 Drawing Sheets

CLOSURE CAPSULE, IN PARTICULAR FOR A RECEPTACLE THAT IS TO CONTAIN A COSMETIC

FIELD OF THE INVENTION

The present invention relates to a closure capsule, in particular for a receptacle that is to contain a cosmetic.

The invention relates more particularly to a capsule in two parts, i.e. firstly a body for fixing to the receptacle and provided with an orifice for dispensing the cosmetic, and secondly a cover suitable for pivoting between a closed position in which it covers said orifice to close it, and a fully-open position enabling the cosmetic to pass therethrough.

BACKGROUND OF THE INVENTION

U.S. Pat. No. 4,887,747 describes a capsule of that type, in which the cover is hinged to the capsule body by means of a stub axle of prismatic cross-section and rotating in bearings constituted by resilient clips. Because of the particular shape of the stub axle, the clips exert a torque on the cover that varies depending on its angular position, and that tends to return it towards its fully-open position and towards its closed position. Making such clips is rather difficult and such a capsule turns out to be complex and expensive to manufacture. In addition, the clips remain visible in all positions of the cover and they leave gaps between themselves and the stub axle, in which gaps bits of cosmetic and other dirt can become trapped, which is undesirable from the point of view of appearance.

French patent application FR-A-2 460 850 discloses a closure capsule in which the cover is connected by a film hinge to a link member secured to the body of the capsule.

During its opening or closing movement, the cover then rubs against a plane region of the body of the capsule.

It is then necessary to exert a relatively large force to bring the cover into its open position.

German utility model DE-U-91 12 615 discloses a closure capsule in which the cover is hinged directly to a member fixed on the receptacle. That capsule requires the use of a special receptacle and also poses problems of sealing and of reliability if the cover is moved beyond its normal opening stroke.

OBJECTS AND SUMMARY OF THE INVENTION

An object of the present invention is to provide a novel closure capsule which remedies the above-mentioned drawbacks in full or in part.

The invention achieves this by the fact that the body of the capsule presents a portion in relief, and by the fact that the cover is shaped to go past said portion in relief by elastic deformation before reaching its fully-open position.

According to the invention, the end of the link member can be secured to the body of the capsule by any appropriate means, in particular by snap-fastening, adhesive, or heat sealing.

By an appropriate shape for the portion in relief, it is possible to act on the force which needs to be exerted on the cover in order to open the capsule and to close it, and in particular to make it act as a ramp that is easier to overcome in one direction than in the other.

The cover and the capsule body can easily be of different materials and/or of different colors, should that be desired.

The capsule also turns out to be of particularly pleasing appearance because there are no gaps in the hinge region of the cover, unlike the capsule described in above-mentioned U.S. Pat. No. 4,887,747.

In a preferred embodiment of the invention, the cover comes into contact with the capsule body via its free edge on going past said portion in relief.

In this way there is no need for the cover to be made with a special member such as a resilient tongue for the purpose of coming into contact with said portion in relief, and that simplifies manufacture.

The invention makes it possible to adopt a cover of elliptical or circular outline, including a notch suitable for receiving the link member.

The link member preferably includes an end shaped to be fixed by snap-fastening in a slot of the capsule body.

In a particular embodiment, said slot extends parallel to the pivot axis of the cover.

Advantageously, during pivoting of the cover from its closed position to its fully-open position, the regions of the cover that are situated on either side of the film hinge come to bear in setbacks of the capsule body, prior to overcoming said projection.

Thus, when opening the capsule, it is possible to ensure that the force required to overcome said relief is more progressive, and when closing the capsule, it is possible to give the user the impression that displacement of the cover is assisted.

In a particular embodiment, the cover goes past said portion in relief by elastic deformation which takes place over a first rotary stroke of the cover before it goes past said relief, after which the material returns to its initial configuration over a second rotary stroke of the cover that is shorter than the first.

The invention also provides a receptacle fitted with a closure capsule as defined above.

BRIEF DESCRIPTION OF THE DRAWINGS

Other characteristics and advantages of the present invention appear on reading the following detailed description of a non-limiting embodiment of the invention, and on examining the accompanying drawings, in which.

MORE DETAILED DESCRIPTION

Figure 1:
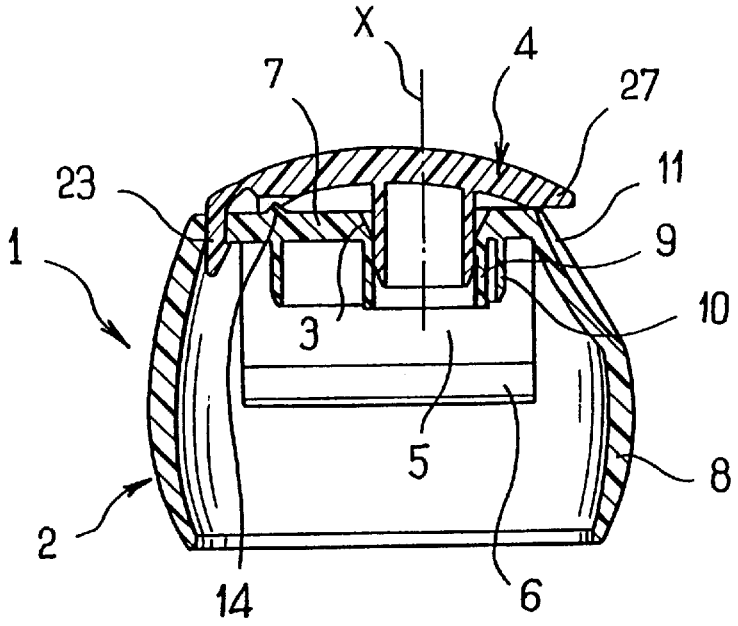
FIG. 1 is a diagrammatic section through a closure capsule constituting an embodiment of the invention, the cover being in its position for closing the dispenser orifice.

FIG. 1 shows a two-part closure capsule 1 constituting an embodiment of the invention.

The capsule 1 has a body 2 for fixing by snap-fastening on the neck of a receptacle (not shown).

The body 2 acts as a section-reducer and includes a dispenser orifice 3 which is circularly symmetrical about an axis X, for delivering the substance contained in the receptacle.

Figure 2:
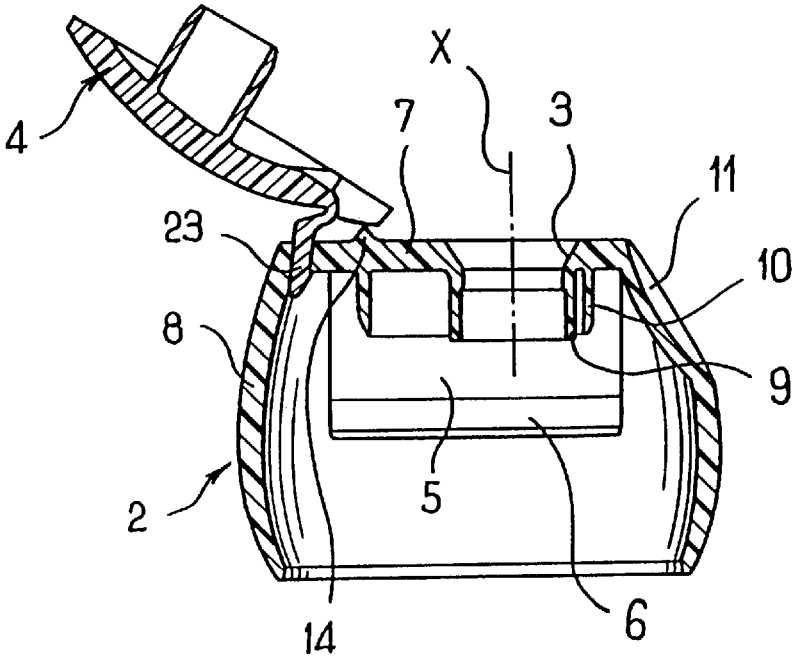
FIG. 2 is a section analogous to FIG. 1 showing the capsule when the cover is in its fully-open position.

The capsule 1 also includes a pivoting cover 4 that is movable between a position in which it is folded down onto the body 2 to close the dispenser orifice 3, as shown in FIG. 1, and a fully-open position in which it extends obliquely away from the body 2 to release the dispenser orifice 3, as shown in FIG. 2.

The body 2 is described in greater detail below with reference to FIGS. 3 to 8.

The body 2 is fixed on the neck of the receptacle by two assembly tabs 5 shaped to fit closely around the cylindrical shape of the neck and provided on the insides of their bottom ends with rims 6 suitable for snap-fastening against a portion in relief on the neck.

These assembly tabs 5 are connected at their top ends to a wall 7 extending perpendicularly to the above-mentioned axis X.

The wall 7 is connected at its periphery to a skirt 8 designed to mask the neck of the receptacle.

Figure 3:
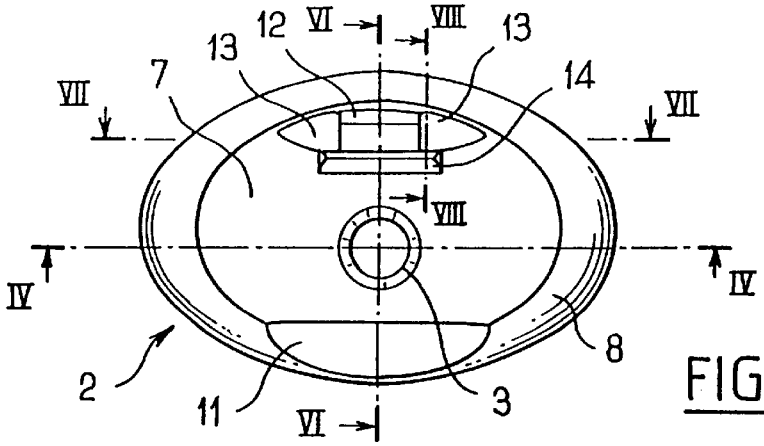
FIG. 3 shows the capsule body seen in isolation and from above.
Figure 4:
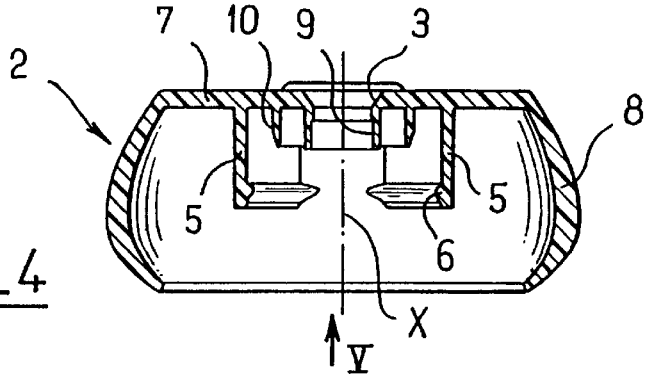
FIG. 4 is a section on section line IV—IV of FIG. 3.
Figure 5:
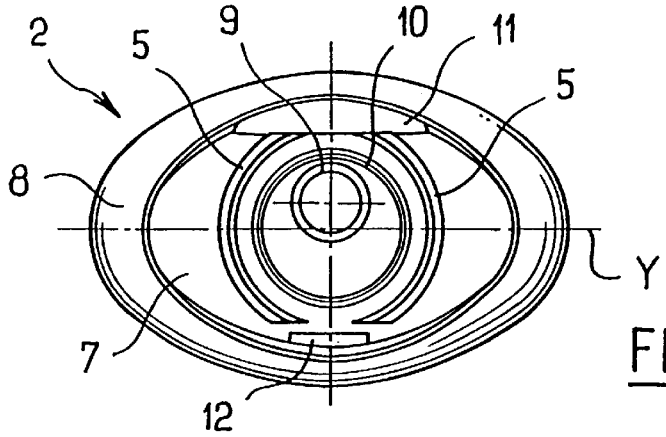
FIG. 5 shows the capsule body in isolation as seen from below, looking along arrow V of FIG. 4.
Figure 6:
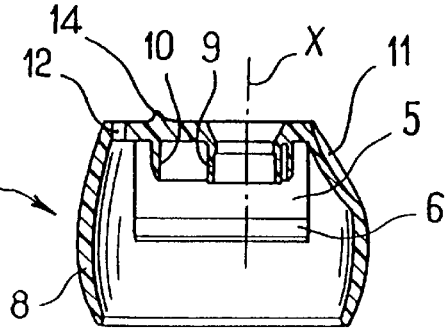
FIG. 6 is a section on section line VI—VI of FIG. 3.
Figure 7:
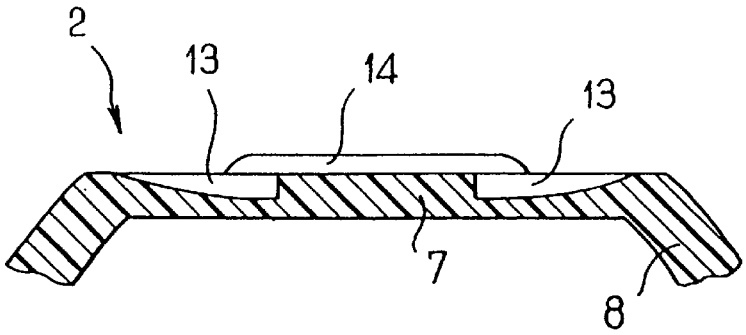
FIG. 7 is a section on section line VII—VII of FIG. 3.

On examining FIG. 3, it will be observed that the wall 7, when seen from above, has an outline that is elliptical, with the axis X being eccentric relative to the center of the ellipse, and with the major axis of the ellipse being referenced Y in FIG. 5.

The dispenser orifice 3 is provided with a reentrant sealing lip 9 which is in parallel with a concentric sealing lip 10 designed to press against the radially inside surface of the neck of the receptacle.

It will also be observed that a setback 11 is formed on the outside surface of the body 2 to enable the user to pass a finger under the cover 4 for the purpose of opening the capsule 1, as explained below.

On its side opposite from the setback 11, the body 2 has a slot 12 parallel to the axis Y.

The slot 12 is disposed axially between two setbacks 13, as can be seen in FIG. 3, for a purpose that is explained below.

The body 2 also includes, between the slot 12 and the dispenser orifice 3, an elongate projection 14 extending parallel to the axis Y over a length which is longer than the length of the slot 12, so that its axial ends run along the edges of the setbacks 13 for a certain distance.

Figure 8:
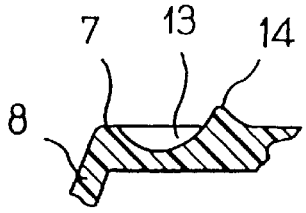
FIG. 8 is a section on section line VIII—VIII of FIG. 3.

In its end regions adjacent to the setbacks 13, the projection 14 is shaped so that its side surface facing towards the slot 12 lies in line with the surface of the setbacks 13, as can be seen in FIG. 8.

The cover 4 is described below with reference to FIGS. 9 to 14.

Figure 9:
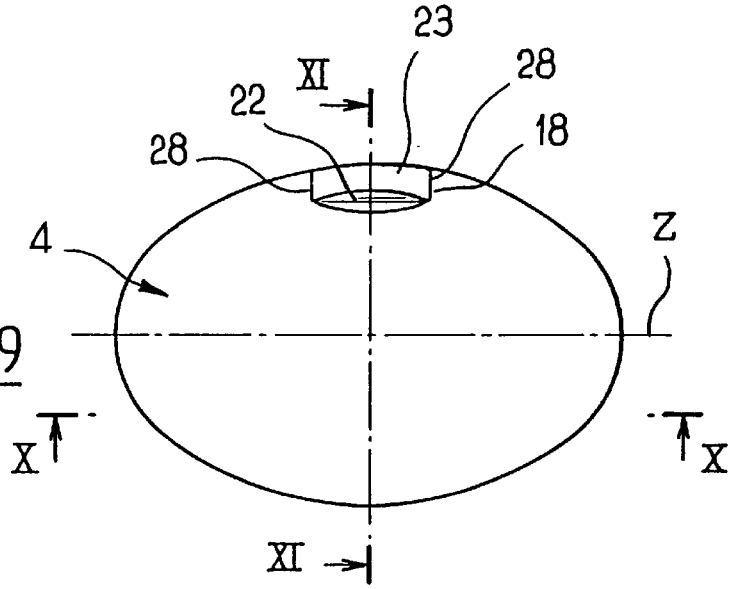
FIG. 9 shows the cover in isolation as seen from above.

In plan view, the size of the cover is close to the size of the wall 7, and as shown in FIG. 9, its outline is elliptical.

The major axis of the ellipse is referenced Z.

Figure 10:
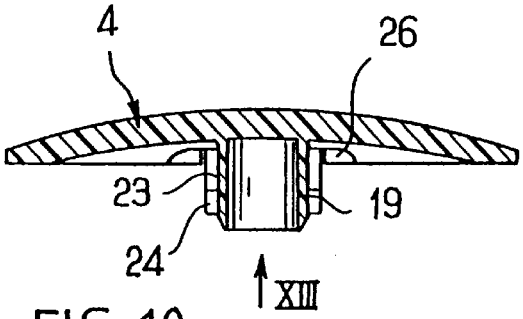
FIG. 10 is a section on section line X—X of FIG. 9.
Figure 11:
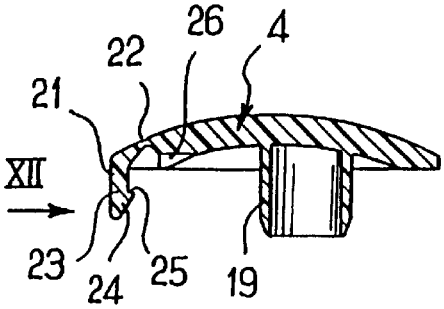
FIG. 11 is a section on section line XI—XI of FIG. 9.
Figure 12:
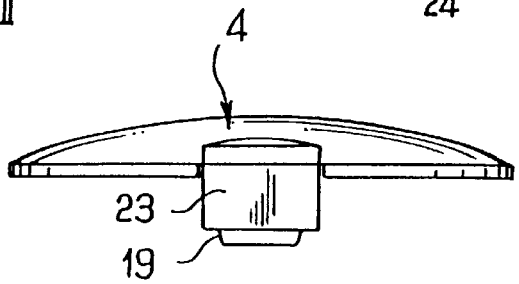
FIG. 12 is an elevation view looking along arrow XII of FIG. 11.

The cover 4 also bulges outwards a little, as can be seen in FIGS. 10 and 11, in particular.

The cover 4 is also provided at its periphery with a substantially rectangular notch 18 extending symmetrically on either side of a midplane perpendicular to the axis Z.

An annular sealing lip 19 is formed on the inside face of the cover 4 to be inserted in the dispenser orifice 3 in contact with the sealing lip 9 when the cover 4 is folded down onto the wall 7.

The cover 4 is connected by a film hinge 22 to a first end 21 of a link or anchor member 23 designed to be inserted and snap-fastened in the slot 12 of the body 2 via its second end 24.

The film hinge 22 is connected to the cover 4 in the bottom of the notch 18, as shown in FIG. 9, and enables the cover 4 to pivot about a geometrical axis of rotation that is parallel to the axis Z and to the axis Y.

The second end 24 of the anchor member 23 is tapered and forms a catch 25 designed to go through the slot 12 by elastic deformation and thereafter hold the cover 4 in place so that it cannot be removed.

Figure 13:
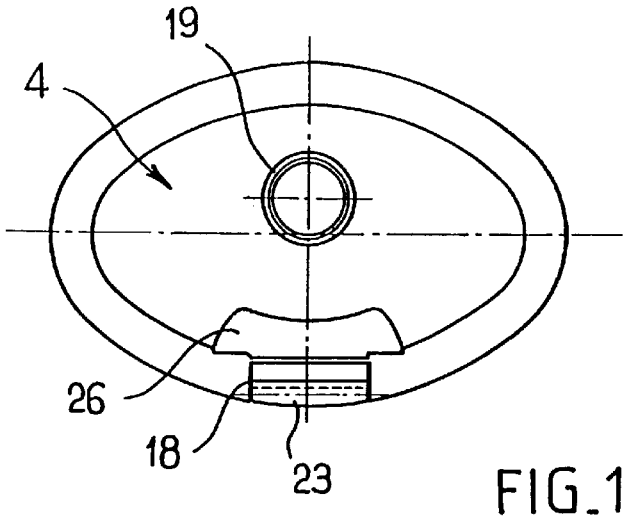
FIG. 13 is a view of the cover in isolation as seen from below.
Figure 14:
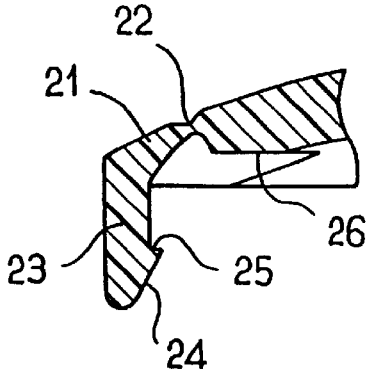
FIG. 14 is a view on a larger scale showing an embodiment detail of the cover.

The anchor member 23 is advantageously shaped in such a manner, that when seen from above, it lies within the continuity of the outline of the cover 4, as can be seen in FIGS. 9 and 13.

The inside surface of the cover 4 is hollowed out in the vicinity of the film hinge 22 to constitute a housing 26 designed to receive the projection 14 when the cover 4 is folded down onto the body 2, as shown in FIG. 1.

To assemble the cover 4 on the body 2, the anchor member 23 is pushed home into the slot 12.

When the capsule 1 is closed, as shown in FIG. 1, the edge 27 of the cover 4 which is situated remote from the anchor member 23 slightly overlaps the setback 11, thereby giving the user a hold, enabling the cover 4 to be raised by using a finger.

Figure 15:
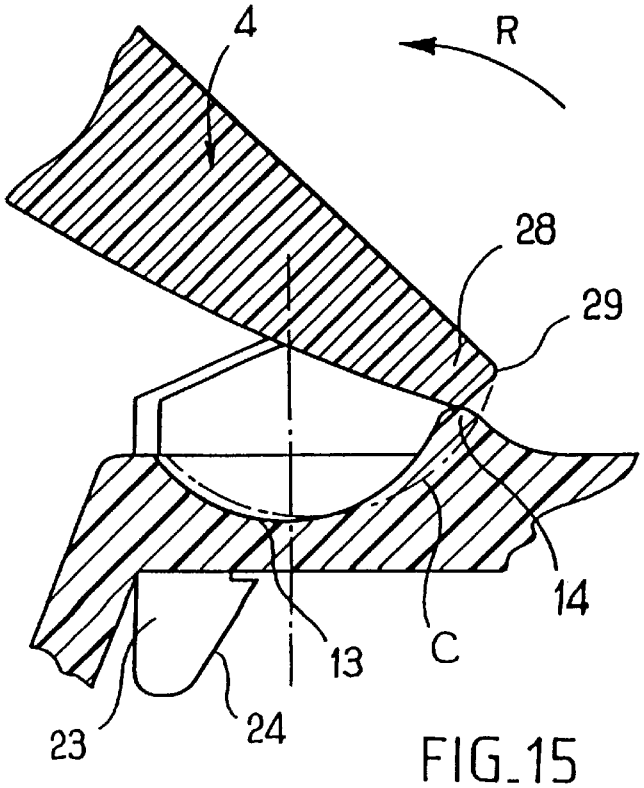
FIG. 15 is a section showing how the cover is held in its fully-open position.

The regions 28 of the cover 4 on either side of the notch 18 and the film hinge 22 pivot during rotation of the cover in the setbacks 13, as will be understood on examining FIG. 15, with the direction of rotation of the cover towards its fully-open position being marked by arrow R.

The path followed by the free edge 29 of the cover 4 in said regions 28 describes a circle C which, in the example described, intersects the surface of the setbacks 13 at about one-third of the travel of the cover, i.e. when the cover 4 has pivoted through about 45°.

As the rotary movement of the cover 4 continues, the edges 29 of the regions 28 continue to bear against the surfaces of the setbacks 13, thereby compressing and elastically deforming the material thereof.

This deformation continues to increase until the moment when the regions 28 have gone past the top of the projection 14, i.e. when the cover has reached its fully-open position as shown in FIGS. 2 and 15.

The matter which was compressed then returns to its initial shape because of its elasticity, and the cover 4 is locked in its fully-open position by the regions 18 pressing against the top of the projection 14.

To close the cover 4, the user pushes against the back of the cover with a finger to cause it to pivot in the direction opposite to arrow R.

Once the thrust exerted on the cover 4 is sufficient, the regions 28 go past the projection 14 in the opposite direction, by deforming elastically.

During the opening movement, the elastic deformation of the material takes place over a stroke that is relatively long while its return to its initial configuration takes place over a stroke that is relatively short after getting past the projection 14.

During the closure movement, deformation on contact with the projection 14 takes place over a stroke that is relatively short while return to the initial configuration takes place over a stroke that is relatively long, after getting past the projection 14.

Thus, by returning progressively to its initial shape, the material which is elastically compressed on contact with the projection 14 gives the user the impression that closure of the cover is being assisted.

Going past the projection 14 during the movement of closing the cover is also made easier by the fact that the edge 29 is slightly chamfered, as can be seen in FIG. 15.

Naturally, various modifications can be made to the capsule as described above without going beyond the ambit of the present invention.

In particular, other means could be provided for fixing the capsule on the neck of the receptacle, and, for example, screw fastening could be used instead of snap-fastening.

What is claimed is:

1. A closure capsule for a receptacle, the capsule comprising a body for fixing to the receptacle and provided with a dispenser orifice, and a cover for pivoting between a closed position in which it covers said orifice to close it, and a fully-open position in which it uncovers said orifice to enable the substance contained in the receptacle to be dispensed, the cover being connected by a film hinge to a link member secured to the body of the capsule, wherein the capsule body has a projection, and the cover is shaped so as to go past said projection by elastic deformation prior to reaching its fully open-position.

2. A capsule according to claim 1, wherein said cover has a free edge and comes into contact with the capsule body via its free edge on going past said projection.

3. A capsule according to claim 1, wherein said link member includes an end shaped to be fixed by snap-fastening in a slot in the capsule body.

4. A capsule according to claim 3, wherein said slot extends perpendicularly to the pivot axis of the cover.

5. A capsule according to claim 1, wherein, when seen from above, the outline of said cover is substantially elliptical or circular, being provided with a notch in which said link member is received.

6. A capsule according to claim 1, wherein said projection extends parallel to the pivot axis of the cover.

7. A capsule according to claim 6, wherein the cover has regions situated on either side of the film hinge, said regions having edges, and wherein during the pivot movement of the cover from its closed position, the edges come to bear in setbacks of the capsule body, and then against said projection.

8. A capsule according to claim 1, wherein the cover goes past said projection by elastic deformation, the elastic deformation of the material taking place over a first rotary stroke of the cover prior to going past said projection, and then after going past said projection, the material returns to its initial configuration over a second rotary stroke of the cover which is shorter than the first.

9. A receptacle fitted with a closure capsule as defined in claim 1.

10. A closure capable for a receptacle, the capsule comprising a body for fixing to the receptacle and provided with a dispenser orifice, and a cover for pivoting between a closed position in which it covers said orifice to close it, and a fully-open position in which it uncovers said orifice to enable a substance contained in the receptacle to be dispensed, the cover being connected by a film hinge to a link member secured to the body of the capsule, wherein the capsule body has a projection, and the cover is shaped so as to go past said projection by elastic deformation prior to reaching its fully-open position, the capsule body has setbacks on either side of the link member, the cover has regions situation on either side of the film hinge, said regions having edges, and during pivot movement of the cover from its closed position, said edges pivot in said setbacks without bearing in said setbacks during a first rotary stroke about 45°.

* * * * *